US006315382B1

(12) United States Patent
Gudaitis et al.

(10) Patent No.: US 6,315,382 B1
(45) Date of Patent: Nov. 13, 2001

(54) PRINTER DRIVE ROLLER POSITIONING

(75) Inventors: Algird M Gudaitis; Christopher M Lesniak, both of Vancouver; Stephen A Smith, Ridgefield, all of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/212,092

(22) Filed: Dec. 15, 1998

(51) Int. Cl.[7] ..... B41J 29/393
(52) U.S. Cl. ..... 347/19
(58) Field of Search ..... 347/19, 40, 12, 347/14, 16; 346/140

(56) References Cited

U.S. PATENT DOCUMENTS 5,349,375 * 9/1994 Bolash et al. ..... 346/140
6,017,114 * 1/2000 Elgee et al. ..... 347/40
6,158,344 * 12/2000 Walker et al. ..... 347/16

* cited by examiner

*Primary Examiner*—John Barlow
*Assistant Examiner*—Ly T Tran

(57) ABSTRACT

Discussed herein is a method of positioning a printer's drive roller relative to the printer's printhead. The printhead has rows of individual print elements arranged to apply transverse dot rows to a print medium. To print at a desired location on the print medium, the printer initiates a first drive roller advance to the desired location, at a relatively fast slew speed. Assuming some overshoot or undershoot occurs, the printer then determines the actual position error of the drive roller, and selects a set of the printhead rows that correspond most closely in position to the desired print location. The printer then initiates a second drive roller advance, at a relatively slow speed, to position the selected group of printhead rows accurately over the desired print location on the print medium. These printhead rows are then used to perform the actual printing. The slow speed of the second drive roller advance ensures high positioning accuracy. However, the distance of this advance is limited because of selecting the closest set of printhead rows. This decreased distance decreases the overall time consumed by drive roller advances.

17 Claims, 6 Drawing Sheets

PRINTER DRIVE ROLLER POSITIONING

TECHNICAL FIELD

This invention relates in general to inkjet printers and in particular to methods of speeding the process of positioning a printer's drive roller for sequential printhead swaths.

BACKGROUND OF THE INVENTION

Many matrix-type printers, including inkjet printers, operate by repeatedly sweeping a printhead transversely over a print medium to print a number of dot rows. Each such sweep is referred to as a swath. The print medium is advanced longitudinally between each swath, so that the entire surface of the print medium is eventually covered.

As printing technologies improve and the pitch of the dot rows decreases, the accuracy with which the print medium advances becomes more critical. Inaccuracies in print medium positioning result in artifacts or bands on the printed page. For example, inaccuracies might cause two swaths to partially overlap, creating a noticeable and undesirable band of dot rows that has been printed twice.

Current media advance systems often use closed-loop servos to improve accuracy. However, increasing requirements for accuracy often limit the speed at which such servo systems can operate. Typically, significant inaccuracies and control system instabilities can be traced to drive train backlash. Accordingly, an effort is made to avoid overshoot when positioning the print medium, thereby avoiding backlash effects. To accomplish this, two positioning steps are often used. In a first step, the system slews at a relatively fast speed to an initial target position that is well short of the final desired position. The initial target position is selected so that the positioning step always stops short of the ultimate desired position, accounting for the worst case of positioning overshoot. In a second step, the servo system "creeps" forward very slowly to the final target. The slow speed avoids overshooting during this second positioning step, resulting in very accurate positioning.

During the slew portion of the positioning procedure, there is a variable amount of positioning error. This error, as an example, might vary between plus and minus four dot rows. To avoid overshoot, the initial target position is selected to be four dot rows short of the final target, thereby ensuring that overshoot will not occur. Given, however, that both positive and negative positioning errors might occur, the actual position attained during the slew positioning step might be as much as eight dot rows short of the final target position. Thus, the distance from the initial target position to the final desired position can be quite large. As a result, the second positioning step often accounts for a significant portion of the total media advance time, and throughput is severely restricted by the "creeping" of the print medium toward its final position.

Some printers provide a way to improve speed by implementing a "draft mode," in which the second positioning step is simply omitted. However, the quality of printing is noticeably poorer in this mode.

SUMMARY OF THE INVENTION

A printer in accordance with the invention uses a printhead that has more nozzle rows than the number of dot rows in any given swath. The printer uses a variable subset of adjacent nozzle rows to account for drive roller positioning inaccuracies. For example, in one embodiment of the invention the printer moves its drive roller in a single advance using a relatively fast (but inaccurate) slew speed. Any resulting positioning inaccuracies are accounted for by ascertaining the actual position of the drive roller after the single advance and by then selecting a subset of nozzles that is closest in position to the actual positions of the desired dot rows after the single advance procedure. As an improvement to this method, a second advance can be utilized, at a slow "creep" speed, to advance the print medium so that the dot rows of the current swath lie precisely (within the tolerance of the position feedback mechanism) beneath the selected subset of nozzles. Because of selecting the closest set of nozzles, the distance of this second move is never more than a single dot row.

The invention can also be used in a system that uses a stepper motor instead of a servo-feedback system, to achieve dot pitches that are smaller than the positioning resolution of the stepper motor. In a system such as this, the stepper motor is advanced as closely as possible to the target position, given the limited resolution of the stepping mechanism. Then, a subset of nozzles is selected to correspond as closely as possible to the desired positions of the dot rows. Because of the finer pitch of the dot rows on the printhead, this results in dot row placement with a resolution that exceeds that of the stepper motor.

DETAILED DESCRIPTION

The invention is described in the context of a printer, such as an inkjet printer, that applies a printed pattern on a print medium such as paper. The invention relates particularly to the media advance mechanism of such a printer, which is commonly embodied as a drive roller.

Figure 1:
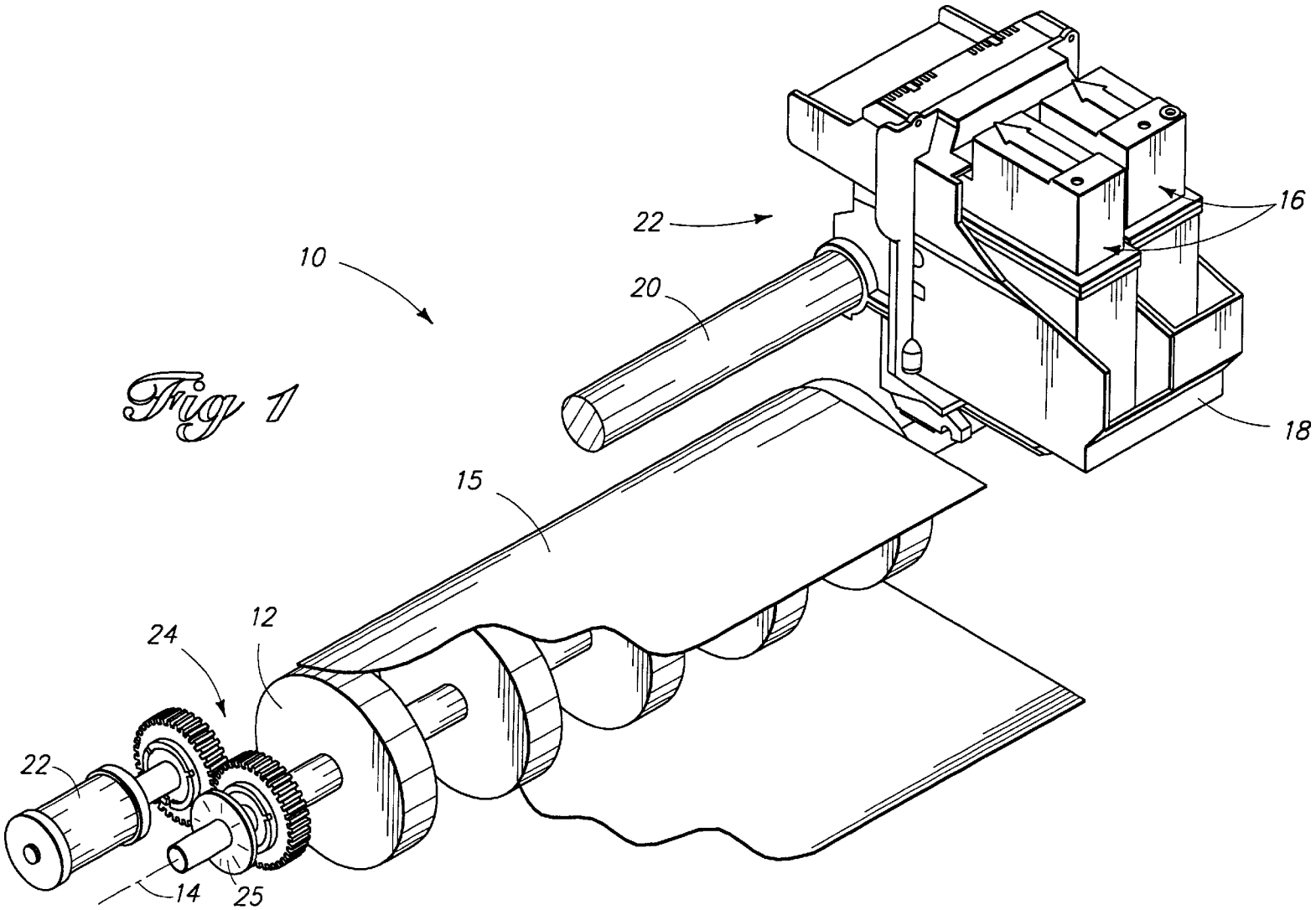
FIG. 1 is a perspective view of media advance and printhead mechanisms in accordance with the invention.

FIG. 1 shows a media advance and printhead mechanism 10 as used in a typical inkjet printer. It includes a drive roller or platen 12 that rotates about a drive roller axis 14 to advance and position paper 15 or some other printable sheet media longitudinally relative to a printhead or printheads 16. The printheads are mounted on a carriage 18 that moves transversely across the underlying paper and the supporting drive roller. The carriage is supported on a transverse carriage support rod 20 and is driven back and forth across the paper by a mechanism that is not shown. The term "transverse" indicates a direction across the paper that is perpendicular to the direction of paper movement. The term "longitudinal" is used to indicate a direction that is parallel with the direction of paper movement.

Figure 2:
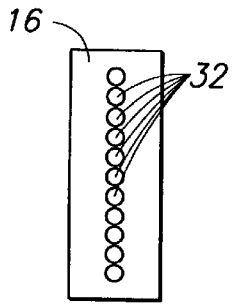
FIG. 2 is a conceptualized drawing of a printhead in accordance with the invention.

FIG. 2 illustrates a very simplified configuration of an inkjet printhead 16 having a plurality of print elements 32, which in this case comprise inkjet nozzles. Generally, the nozzles form rows and columns. In this simplified example, the printhead has a single column of nozzles. The column extends longitudinally, in the direction of paper movement.

Each row is formed by a single nozzle. In actual embodiments, such as in color printers, a printhead row is often formed by a plurality of nozzles, corresponding respectively to different color components. The spacing between nozzle rows is known with a high degree of accuracy.

Referring again to FIG. 1, drive roller 12 is driven by a motor 22 through gearing 24. A position encoder 25 or other position feedback sensor is connected to monitor the position of motor 22 and/or roller 12. The position encoder might be associated directly with the motor or might alternatively be more closely associated with the feed roller to give more accurate position feedback. In the example implementation of FIG. 1, the encoder rotates with the drive roller.

Figure 3:
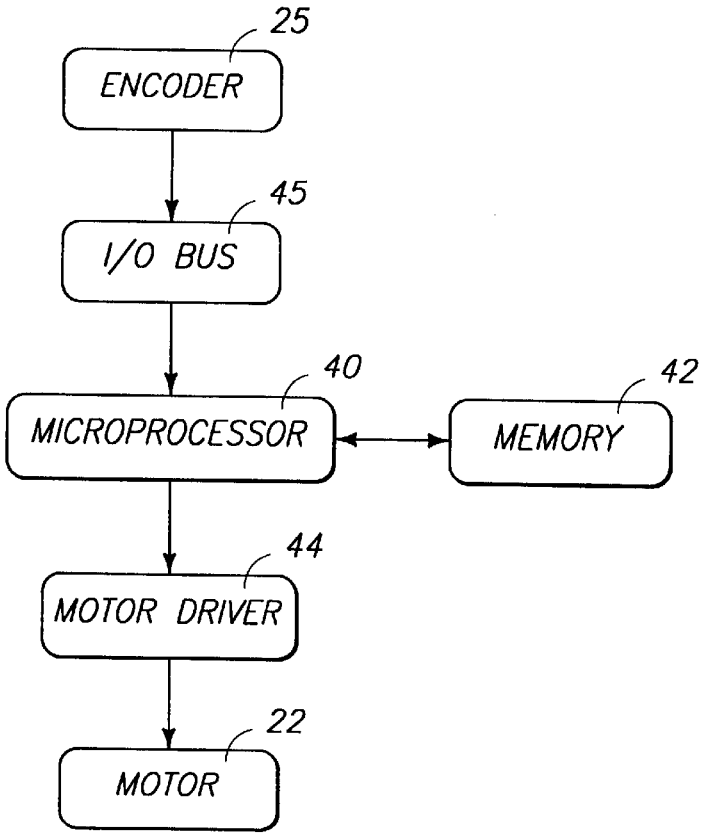
FIG. 3 is a block diagram of control and logic components for performing the steps described below in accordance with the invention.

FIG. 3 illustrates control logic components of a printer used to control the operation of the media advance and printhead mechanism shown in FIG. 1. These components include a programmable microprocessor 40 and associated memory 42. The microprocessor is programmed in accordance with the description given herein to perform the described steps and calculations. As is conventional practice, the microprocessor is programmed by way of instructions stored in and retrieved from memory 42.

The microprocessor is connected through a motor driver 44 to control the movement of motor 22. In addition, the microprocessor utilizes an I/O bus 45 through which it communicates with a position encoder 25. The microprocessor implements a closed-loop servo positioning system to move and position the motor and the drive roller as desired. Alternatively, such closed-loop control might be implemented apart from the microprocessor, such as in a dedicated motion control circuit.

Generally, printhead 16 is responsive to the control logic implemented by microprocessor 40 and memory 42 to pass repeatedly across a print medium in individual, horizontal swaths, to apply transverse dot rows to the underlying print medium. In each swath, rows of nozzles are fired to print corresponding groups of dot rows, also referred to as swaths of dot rows, on the underlying print medium. It should be noted that although the illustrated printhead is sufficient for a conceptual understanding of the invention, actual inkjet printers typically have several columns of longitudinally-staggered nozzles, and each column typically contains a much larger number of nozzles.

Figure 4:
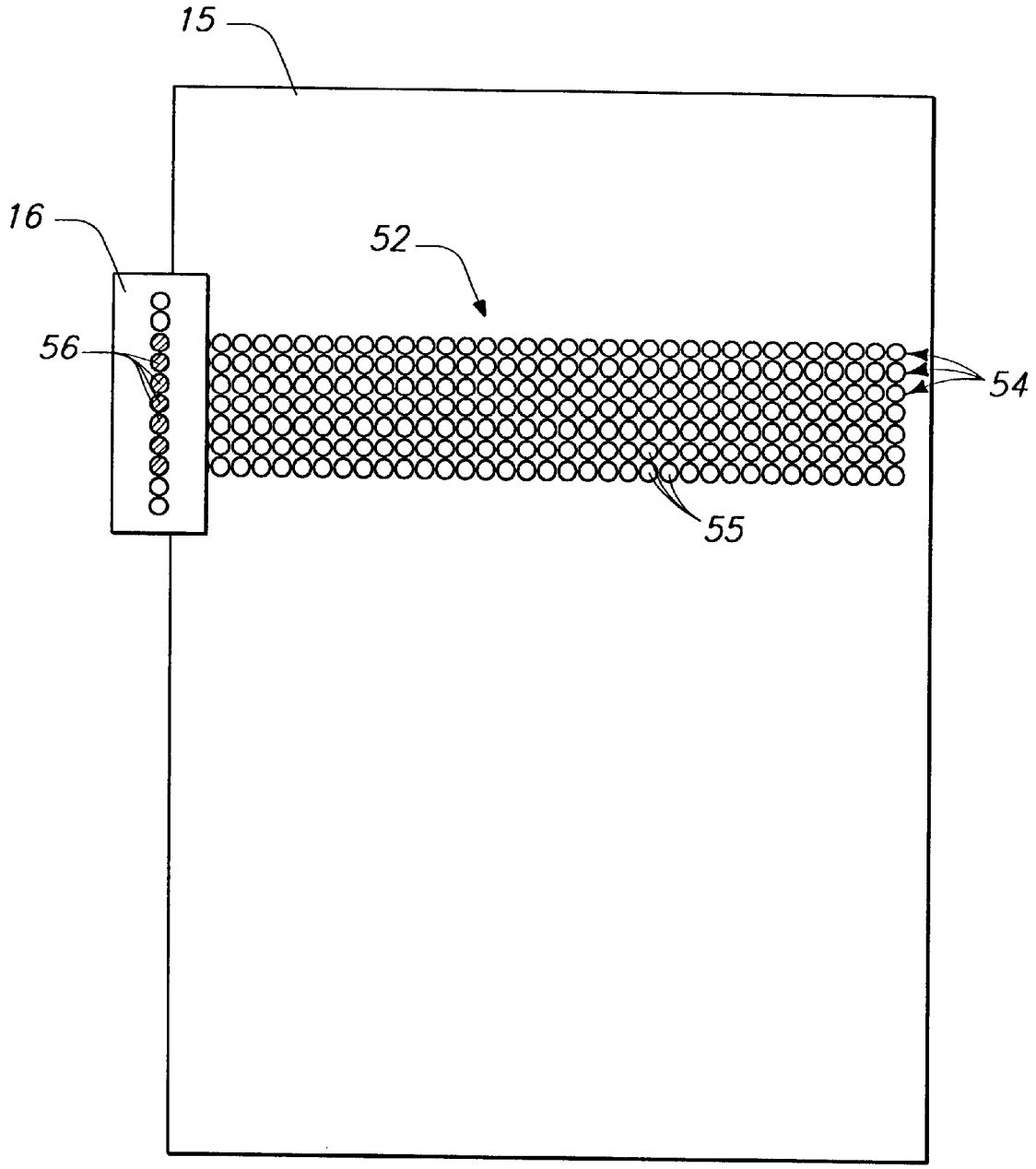
FIGS. 4–8 are conceptual diagrams illustrating printhead nozzle selection and relative printhead and print medium positioning in accordance with the invention.

FIG. 4 shows printhead 16 in relation to a print medium 15 and to a printable swath 52 on medium 15. As discussed above, the swath comprises a plurality of individual dot rows 54, each containing a plurality of dot positions 55. In this hypothetical example the swath has seven rows.

Printhead 16 has a plurality of nozzle rows which are spaced at a pitch equal to the desired pitch of dot rows 54. In accordance with the invention, the printhead has a number of nozzles that is greater than the number of rows in a swath. In this example, the printhead has eleven nozzles or nozzle rows, which is greater than the seven rows of a single swath.

To print swath 52, drive roller 12 is advanced so that the nozzle rows of the printhead are lined up longitudinally with the desired location of a set of one or more dot rows on print medium 15. More specifically, a subset 56 of the printhead rows are aligned with the desired location of a swatch of dot rows, wherein the subset contains a number of adjacent nozzle rows equal to the number of dot rows to be printed in the swath. Such a subset is indicated in FIG. 4 by diagonally hatching the circles representing the nozzles of the subset. FIG. 4 shows the relative positions of the printhead and print medium after the print medium has been properly positioned.

Figure 5:
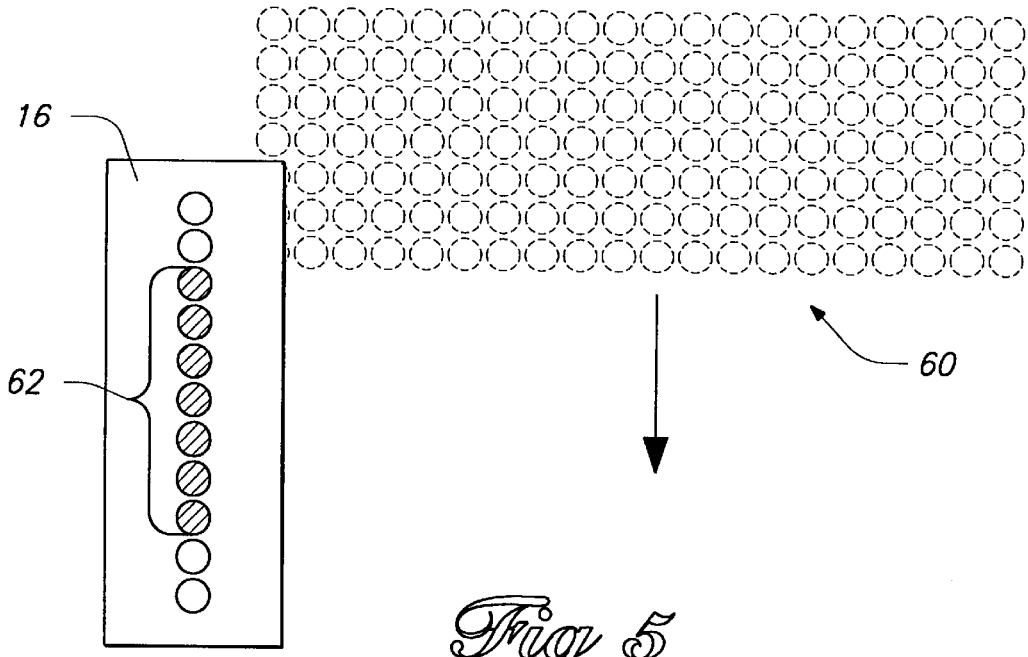
Figure 6:
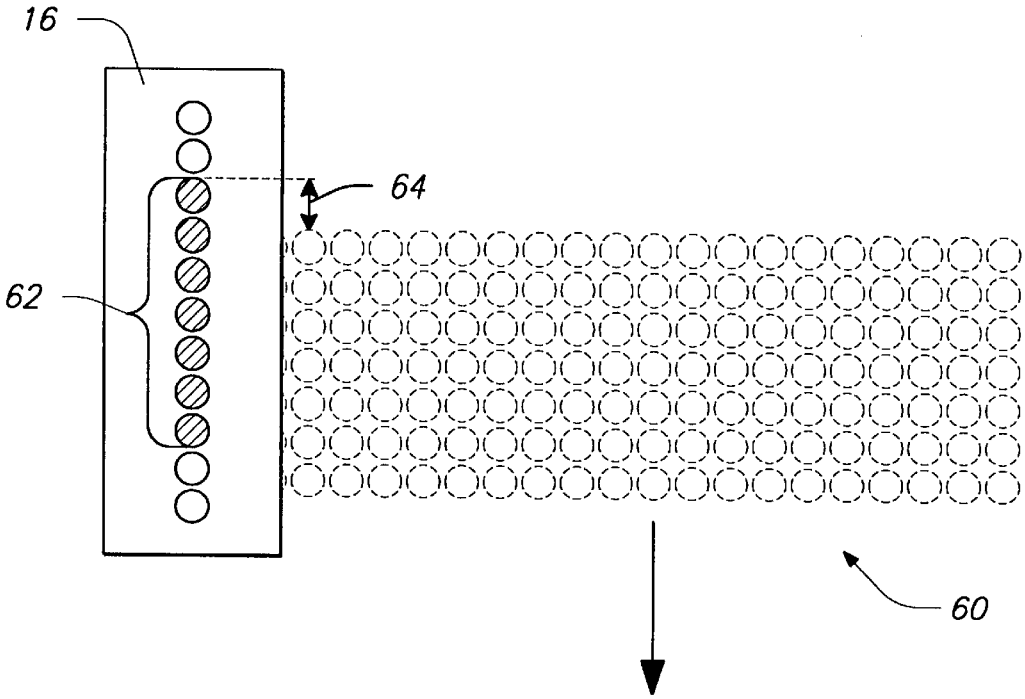
Figure 7:
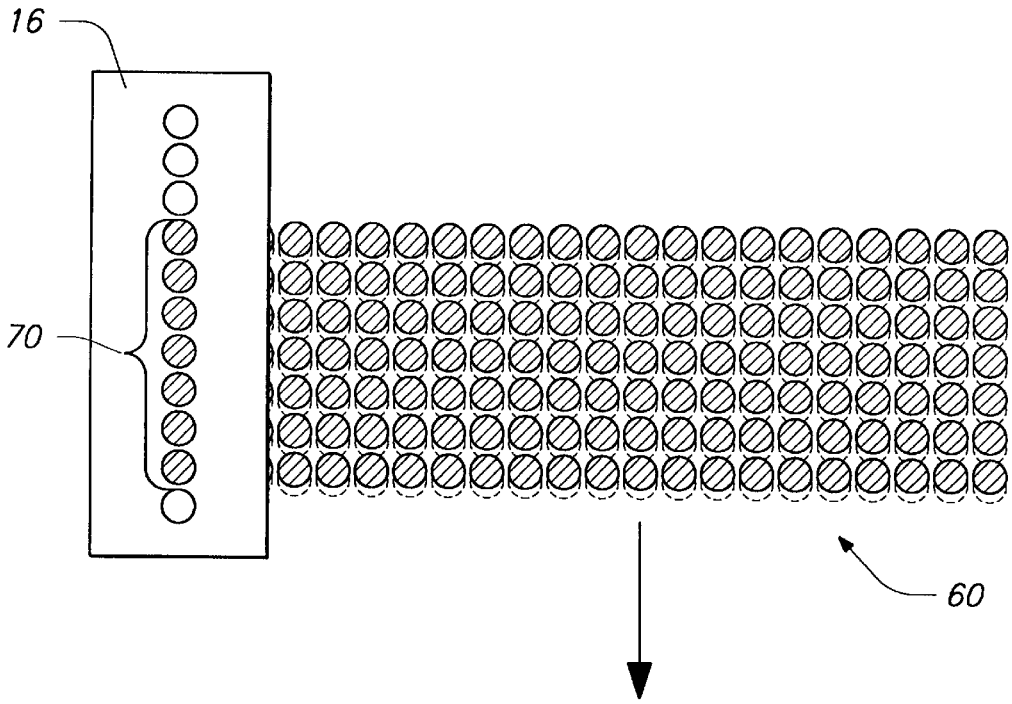

FIGS. 5–7 illustrate one method in accordance with the invention for positioning drive roller 12 and print medium 15 relative to printhead 16, and for then printing a set or swath of one or more dot rows. Generally, this method involves roughly positioning the drive roller, and then selecting an appropriate group or subset of the available nozzles that are positioned longitudinally most closely to the desired locations on the underlying print medium of the swath's dot rows.

FIG. 5 shows the desired position of a swath of dot rows 60 relative to printhead 16 prior to printing the dot rows. In FIGS. 5–8, dashed circles represent the desired or nominal locations of dots and dot rows rather representing actual printed dot locations. In FIG. 5, for instance, the illustrated dots have not yet been printed. Rather, the dot positions are shown at a position in which the print medium has not yet been advanced to the proper position relative to printhead 16. The downward arrow in FIG. 5 indicates the movement of the print medium and the nominal dot positions relative to printhead 16.

At the point illustrated in FIG. 5, the printer has selected a nominal or default set 62 of nozzles to use for printing the swath. The rows of printhead 16 will be referred to as rows or nozzles one through eleven, from top to bottom of the figures. In FIG. 5, the default set of nozzle rows comprises rows three through nine.

An initial step in accordance with the invention comprises initiating a drive roller advance to a target position. The target position is the position of the paper or drive roller that would place the dot rows of swath 60 precisely beneath the corresponding nozzle rows of the default set 62 of nozzle rows. This step is performed at a relatively fast speed, referred to as a slew speed. As discussed above, this type of drive roller advance results in relatively inaccurate drive roller and print medium positioning. Thus, the drive roller is moved to an actual position that is potentially different from the target position.

FIG. 6 shows the result of this step, assuming an overshoot equal to slightly over one row height. The amount of overshoot is indicated in FIG. 6 by reference numeral 64—the print medium moved past its target position by the amount indicated by numeral 64. Note that although the figures illustrate a condition of overshoot, position undershoot is also a possible result of positioning the drive roller at the slew speed.

After the drive roller has been advanced, the control logic notes the actual position of the drive roller (from feedback sensor 25). As shown in FIG. 7, the control logic then selects a new set 70 of the printhead rows that corresponds most closely in longitudinal position to the desired location of the dot rows of swath 60. In this example, the $4^{th}$ through the $10^{th}$ rows are closest to the position of swath 60. Thus, these rows are selected and used to print the swath.

Selecting a new sub-set of the available nozzles for printing swath 60 amounts to shifting the print data for the individual rows. Thus, the print data originally intended for the $3^{rd}$ row of the printhead is shifted to the $4^{th}$ row; the data originally intended for the $4^{th}$ row is shifted to the $5^{th}$ row; and so on.

FIG. 7 shows the result of printing the swath with the selected printhead rows, with the actual printed dots being represented as diagonally hatched circles relative to the underlying dashed circles indicating the nominal positions of the dots. Note that there is a small longitudinal positioning error. However, this error will always be less than half of the row height or dot pitch, which is suitable for "draft mode" printing. In fact, this positioning method improves upon the accuracy of prior art draft modes, without sacrificing speed.

This method can also be utilized in a printer utilizing an open-loop stepper motor, without position feedback. In this case, the invention can be used to increase the vertical or longitudinal resolution of the printer. Specifically, the nozzles of the printer's printhead are arranged at a pitch that is finer than the positioning resolution of the stepper motor. Stated alternatively, the stepper motor has a positional resolution that is coarser than the printhead row spacing. To print a particular swath, the drive roller is positioned as closely as possible to the desired location, within the resolution of the stepper motor. Then, a set of printhead nozzles is selected for printing the swath. The selected set is the group of nozzles that are closest to the desired longitudinal position of the swath.

Figure 8:
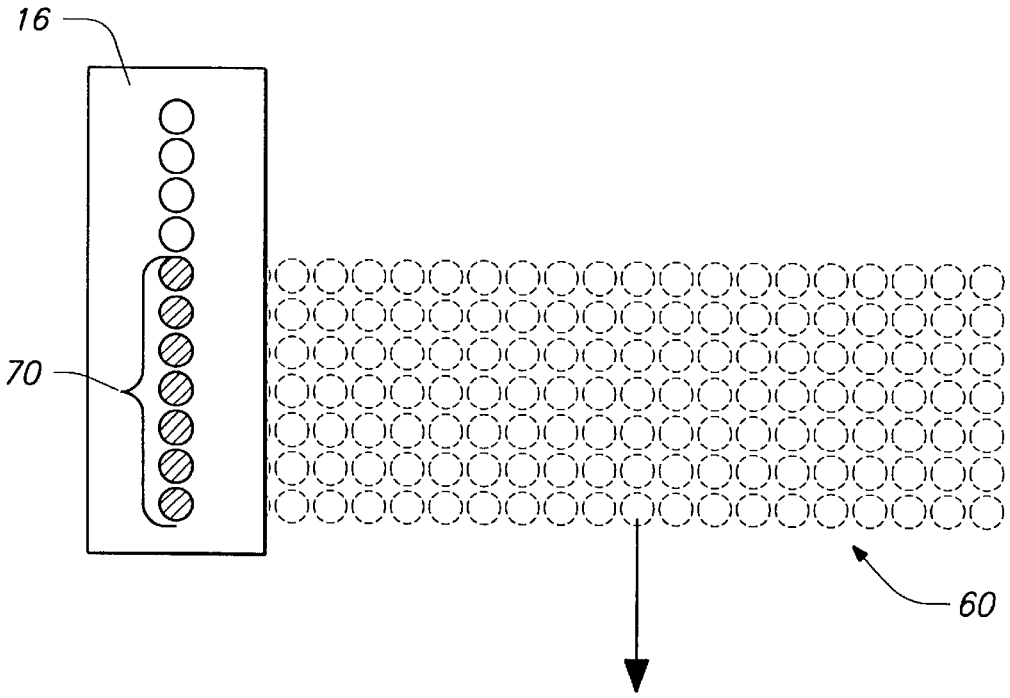

In a system with position f&feedback, the basic steps illustrated above in FIGS. 5–7 can be augmented by a second paper advance to achieve higher accuracy. Rather than printing immediately after choosing the printhead row set 70, a further step is performed of initiating a second drive roller advance to a second drive roller or paper target position that positions the selected set of the printhead rows precisely over the desired swath of dot rows (within the accuracy of the feedback mechanism). This step is performed at a relatively low speed, to achieve relatively high drive roller positioning accuracy. For optimum results, the set of printhead rows is chosen so that a forward paper advance can be performed. The result of this second positioning step is shown in FIG. 8, in which the set of printhead rows is aligned precisely with the selected swath rows.

This method minimizes the distance of the second drive roller advance, thereby providing a significant improvement in positioning speed. The largest advance in this second positioning step will be no more than one row height. This is a significant improvement over the prior art, which might have required a second positioning step of several rows.

Figure 9:
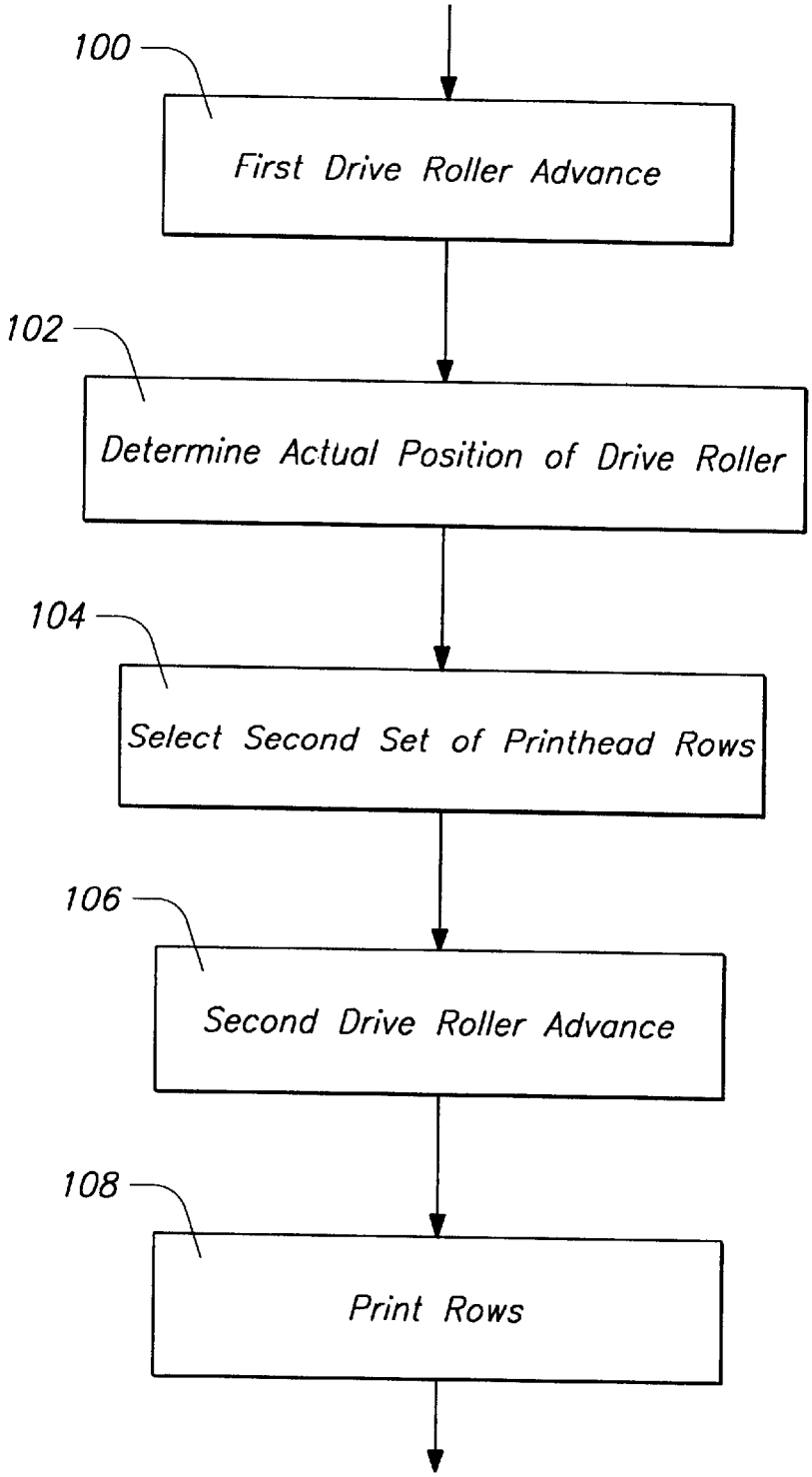
FIG. 9 is a flowchart illustrating methodological aspects of the invention.

FIG. 9 illustrates detailed steps of the invention in the form of a flowchart. An initial step 100 comprises initiating a first drive roller advance to a first drive roller target position. The first drive roller target position is that which would position a first or default set of the printhead rows over the desired location of a swath of row dots. This step is performed at the slew speed of the drive mechanism, resulting in positioning errors, so that the drive roller advances to an actual position that is potentially different than the first drive roller target position.

A step 102 comprises detecting or reading the actual position of the drive roller after the first driver roller advance step 100.

A step 104 comprises selecting a second set of the printhead rows that correspond most closely in position to the desired location of the swath of dot rows, accounting for the actual position of the print medium after advance step 100. This set is selected such that a forward drive roller advance of no more than one row will position the second set of the printhead rows over the desired swath of dot rows.

A step 106 comprises initiating a second drive roller advance to a second drive roller target position that positions the second set of the printhead rows precisely over the desired location of the swath of dot rows, so that the swath can be printed with the second set of the printhead rows.

Step 108 comprises printing the swath of row dots with the second set of printhead rows.

This method of dot shifting, which can be implemented in a printer for little or no cost, corrects for both undershoot and overshoot of a drive roller positioning mechanism. Even though two drive roller advances are usually required, the second, "creep" advance is much shorter than in prior art printers. Specifically, this second advance is of a distance that is never any greater than the dot row pitch. In the prior art, as described in detail above, the second advance was potentially as large as several dot rows. In accordance with the invention, however, the average distance of the second drive roller advance is only half of the dot pitch (assuming that positioning errors in the slew portion of drive roller movement are random). Thus, positioning speed is improved significantly over the prior art.

Furthermore, the invention eases servo design constraints relating to the slew portion of the paper advance, because less accuracy is required during this portion of the paper advance. It also makes the printer more robust to changing print conditions such as changes in media type, operating environment, age, etc.

Although the invention has been described in language specific to structural features and/or methodological steps, it is to be understood that the invention defined in the appended claims is not necessarily limited to the specific features or steps described. Rather, the specific features and steps are disclosed as preferred forms of implementing the claimed invention.

What is claimed is:

1. A printer that applies a printed pattern on a print medium, the printer comprising:

control logic;

a printhead that is responsive to the control logic, the printhead having printhead rows of individual print elements arranged to apply transverse dot rows to the print medium, each printhead row having one or more print elements;

a drive mechanism that is responsive to the control logic to position the print medium longitudinally relative to the printhead;

the control logic being configured to print a set of one or more dot rows by performing steps comprising:

initiating a first drive mechanism advance to a first print medium target position, wherein the first drive mechanism advance positions the print medium to an actual position that is potentially different than the first print medium target position;

detecting the actual position of the print medium after the first drive mechanism advance;

selecting a set of one or more printhead rows that correspond most closely in longitudinal position to a desired location of the set of dot rows, such that a forward drive mechanism advance will position the selected set of printhead rows at the desired location of the set of dot rows;

initiating a second drive mechanism advance to a second print medium target position that positions the selected set of printhead rows at the desired location of the set of dot rows;

printing the set of dot rows with the selected set of printhead rows.

2. A printer as recited in claim 1, wherein the first drive mechanism advance is at a slew speed that results in relatively inaccurate drive mechanism positioning, and wherein the second drive mechanism advance is at a slower speed that allows more precise drive mechanism positioning.

3. A printer as recited in claim 1, further comprising a drive mechanism position sensor to which the control logic is responsive to detect the actual position of the print medium.

4. A printer as recited in claim 1, wherein the printhead has a number of print rows that is greater than the number of dot rows in the set of dot rows.

5. A printer as recited in claim 1, wherein the control logic performs a further step of calculating the first print medium target position as a position that would place a nominal set of the printhead rows over the set of dot rows.

6. A printer as recited in claim 1, wherein the printer is an inkjet printer.

7. A printer as recited in claim 1, wherein the printhead moves transversely across the print medium in repeated swaths to print repeated sets of dot rows.

8. A method of printing in a printer having a drive mechanism and a printhead, the printhead having printhead rows of individual print elements arranged to apply transverse dot rows to the print medium, each printhead row having one or more print elements; the method comprising the following steps:

initiating a first drive mechanism advance to a print medium target position;

after the first drive mechanism advance, selecting a set of printhead rows that correspond most closely in position to a desired location of a set of one or more dot rows;

printing the set of dot rows with the selected set of printhead rows;

wherein the selecting step is performed such that a forward drive mechanism advance will position the selected set of printhead rows at the desired location of the set of dot rows, the method comprising a further step of initiating a second drive mechanism advance to a second print medium target position that positions the selected set of the printhead rows at the desired location of the set of dot rows prior to printing the set of dot rows.

9. A method as recited in claim 8, wherein the first drive mechanism advance is at a slew speed that results in relatively inaccurate drive mechanism positioning, and wherein the second drive mechanism advance is at a slower speed that allows more precise drive mechanism positioning.

10. A method as recited in claim 8, wherein the printhead rows have a known spacing, and wherein the second drive mechanism advance is by a distance that corresponds to no more than the printhead row spacing.

11. A method as recited in claim 8, wherein the printhead rows have a known spacing, the method comprising a further step of advancing the drive mechanism with a stepper motor having a positional resolution that is coarser than the printhead row spacing.

12. A method as recited in claim 8, wherein the printhead has a number of print rows that is greater than the number of dot rows in the set of dot rows.

13. A method as recited in claim 8, comprising a further step of moving the printhead transversely across the print medium in repeated swaths to print repeated sets of print rows.

14. In an inkjet printer, a method of positioning a drive roller relative to a printhead, the printhead having printhead rows of individual nozzles arranged to apply transverse dot rows to the print medium in repeated swaths, each printhead row having one or more nozzles; the method comprising the following steps:

initiating a first drive roller advance to a first drive roller target position that would position a first set of the printhead rows over a desired location of a swath of dot rows on the print medium, wherein the first drive roller advance positions the drive roller to an actual position that is potentially different than the first drive roller target position;

detecting the actual position of the drive roller after the first drive roller advance;

selecting a second set of the printhead rows that correspond most closely in position to the desired location of the swath of dot rows after the first drive roller advance, such that a forward drive roller advance will position the second set of the printhead rows at the desired location of the swath of dot rows;

initiating a second drive roller advance to a second drive roller target position that positions the second set of printhead rows at the desired location of the swath of dot rows, so that the swath of dot rows can be printed with the second set of the printhead rows.

15. A method as recited in claim 14, wherein the first drive roller advance is at a slew speed that results in relatively inaccurate drive roller positioning, and wherein the second drive roller advance is at a slower speed that allows more precise drive roller positioning.

16. A method as recited in claim 14, wherein the printhead rows have a known spacing, and wherein second drive roller advance is by a distance that is no greater than the known printhead spacing.

17. A method as recited in claim 14, wherein the printhead has a number of print rows that is greater than the number of dot rows in the swath of dot rows.

* * * * *